US011937682B2

(12) United States Patent
Dupont et al.

(10) Patent No.: US 11,937,682 B2
(45) Date of Patent: Mar. 26, 2024

(54) REFILLABLE DISPENSER AND METHOD ASSOCIATED THEREWITH

(71) Applicant: SIOTAL INC., Québec (CA)

(72) Inventors: Samuel Lemire Dupont, Laval (CA); Fadi Bergeron, Ville LaSalle (CA)

(73) Assignee: SIOTAL INC. (CA)

( * ) Notice: Subject to any disclaimer, the term of this patent is extended or adjusted under 35 U.S.C. 154(b) by 0 days.

(21) Appl. No.: 17/792,664

(22) PCT Filed: Jan. 13, 2021

(86) PCT No.: PCT/CA2021/050029

§ 371 (c)(1),
(2) Date: Jul. 13, 2022

(87) PCT Pub. No.: WO2021/142540

PCT Pub. Date: Jul. 22, 2021

(65) Prior Publication Data

US 2023/0043069 A1 Feb. 9, 2023

Related U.S. Application Data

(60) Provisional application No. 62/960,758, filed on Jan. 14, 2020.

(51) Int. Cl.

| | |
|---|---|
| ***A45D 40/04*** | (2006.01) |
| ***A45D 40/06*** | (2006.01) |
| ***A45D 40/16*** | (2006.01) |

(52) U.S. Cl.

CPC ..... *A45D 40/04* (2013.01); *A45D 40/06* (2013.01); *A45D 40/16* (2013.01)

(58) Field of Classification Search

CPC ..... A45D 40/04; A45D 40/00; A45D 40/02; A45D 40/06; A45D 40/14; A45D 40/16;

(Continued)

(56) References Cited

U.S. PATENT DOCUMENTS 2,085,446 A * 6/1937 Philippe ..... A45D 40/0075 401/265

2,422,705 A 6/1947 Saint Clair (Continued)

FOREIGN PATENT DOCUMENTS

CA 2096440 C 5/1992
EP 0178188 A2 4/1986

(Continued)

OTHER PUBLICATIONS https://www.wearewild.com/., Sustainable Natural Deodorant That Works | Wild Natural Deodorant—Wild UK., Retrieved Jul. 7, 2022., pp. 1-4.

(Continued)

*Primary Examiner* — David J Walczak

(74) *Attorney, Agent, or Firm* — The Belles Group, P.C.

(57) ABSTRACT

A refillable dispenser for receiving consumable pods, such as deodorant pods and lipstick pods, that are gradually consumed during use, is provided. The refillable dispenser includes a base container, a pod housing for receiving the pod which is vertically displaceable within the base container, and a dispensing mechanism for moving the pod housing relative to the base container between an uppermost and a lowermost configuration. Lowering the pod housing in the base container causes an upper portion of the pod to extend through an opened top defined by the pod housing. In the uppermost configuration, a new pod introduced within the pod housing will have its upper portion extending through the opened top of the pod housing and will be dispensable therefrom, while in the lowermost configuration, an almost fully dispensed pod can be removed from the pod housing, or alternatively, the pod can be fully dispensed.

18 Claims, 17 Drawing Sheets

(58) Field of Classification Search
CPC ..... A45D 40/205; A45D 2040/208; B65D 83/0005; B65D 83/0011
USPC ..... 401/68, 75, 86, 87
See application file for complete search history.

(56) References Cited

U.S. PATENT DOCUMENTS

| | | | | |
|---|---|---|---|---|
| 2,565,346 | A | 8/1951 | Baselton | |
| 3,912,403 | A * | 10/1975 | Gjerloff | A45D 40/02 D8/30 |
| 4,232,977 | A | 11/1980 | Chutter | |
| 4,580,920 | A | 4/1986 | Schmidt | |
| 5,166,311 | A | 11/1992 | Nichols | |
| 5,505,041 | A | 4/1996 | Harlan | |
| 6,200,048 | B1 | 3/2001 | Bouix | |
| 7,021,849 | B2 * | 4/2006 | Ramet | A45D 40/262 401/176 |
| 8,821,056 | B2 | 9/2014 | Walling et al. | |
| 8,875,955 | B2 | 11/2014 | Arora et al. | |
| 9,433,275 | B2 | 9/2016 | Crawford et al. | |
| 9,723,907 | B2 | 8/2017 | Huang et al. | |
| 10,278,473 | B2 | 5/2019 | Groffsky et al. | |
| 2011/0194884 | A1 | 8/2011 | Kim | |
| 2018/0249808 | A1 | 9/2018 | Crawford et al. | |
| 2019/0357657 | A1 | 11/2019 | Presche | |

FOREIGN PATENT DOCUMENTS

| | | | |
|---|---|---|---|
| FR | 2517941 | A1 | 6/1983 |
| WO | 2002003830 | A1 | 1/2002 |

OTHER PUBLICATIONS https://www.mymyro.com/., Myro Refillables: Body Wash, Deodorant., Plastic-free bodywash. Just add water, Retrieved Jul. 7, 2022., pp. 1-15.

https://laruchequebec.com/en/projet/25d7c629-7a60-4955-9f45-01726af74175., ika déodorant naturel rechargeable., Retrieved Jul. 7, 2022, pp. 1-1.

Search Report issued in counterpart European Patent Application No. 21741061.2 dated Jan. 4, 2024.

* cited by examiner

REFILLABLE DISPENSER AND METHOD ASSOCIATED THEREWITH

RELATED PATENT APPLICATION

The present application is a U.S. national stage application under 35 U.S.C. § 371 of PCT application no. PCT/CA2021/050029, filed on Jan. 13, 2021, which claims priority from U.S. provisional patent application No. 62/960,758, filed on Jan. 14, 2020 and entitled "REFILLABLE DISPENSER AND METHOD ASSOCIATED THEREWITH," the disclosures of which are hereby incorporated by reference in its their entirety.

TECHNICAL FIELD

The present disclosure relates to hygienic or cosmetic product dispensers, such as deodorant dispensers. More particularly, the present disclosure relates to refillable, and thus reusable, dispensers configured to receive consumable pods that can be gradually consumed during use, allowing the end user to refill the dispenser with a new pod instead of disposing of the whole dispenser.

BACKGROUND

Dispensers for dispensing solid or gel products, such as deodorant or antiperspirant products, are well known in the art. Usually, the deodorant or antiperspirant product is extruded or dispensed out of an outlet provided in a top end of the dispenser until the product is fully dispensed or almost fully dispensed. Such dispensers are limited to a single use as after the product has been consumed, the end user is left with no option other than disposing the empty dispenser and purchasing a new one. The single-use nature of these dispensers leads to excessive expenses for the consumers, as well as too important wastes, resulting in an unecological option.

There exists on the market some refillable dispensers for receiving consumable pods. The configuration of such refillable dispensers however requires the pod refills to be integrated with a pod support, which also needs be disposed after the product has been consumed, leading to excessive expenses and wastes.

There is therefore a need for an improved refillable, and thus reusable, dispenser configured so as to allow the end user to refill the dispenser with a new pod instead of disposing of the whole dispenser, and which, by virtue of its design and components, would be able to overcome or at least minimize some of the above-discussed concerns.

SUMMARY

It is an object of the present disclosure to provide a refillable dispenser that overcomes or mitigate one or more disadvantages of known refillable dispensers, or at least provide useful alternatives.

It is another object of the present disclosure to provide a refillable deodorant dispenser that overcomes or mitigate one or more disadvantages of known refillable deodorant dispensers, or at least provide useful alternatives.

In accordance with an embodiment, there is provided a refillable dispenser for receiving consumable pods that are gradually consumed during use, comprising: a base container; a pod housing, defining an opened top, for receiving the pod therein, the pod housing being vertically displaceable within the base container; and a dispensing mechanism for moving the pod housing relative to the base container, between an uppermost configuration and a lowermost configuration, while maintaining the pod stationary relative to the base container, wherein lowering the pod housing relative to the base container as the pod is consumed causes an upper portion of the pod to extend through the opened top of the pod housing; wherein in the uppermost configuration, a new pod introduced within the pod housing has the upper portion extending through the opened top of the pod housing and can be dispensed therefrom; and wherein in the lowermost configuration, an almost fully consumed pod can be removed from the pod housing.

In accordance with another embodiment, the dispensing mechanism can comprise a pod holder within the pod housing for supporting the pod. The dispensing mechanism can be configured to maintain the pod holder stationary relative to the base container as the pod housing is displaced within the base container between the uppermost configuration and the lowermost configuration.

In accordance with a further embodiment, the base container can comprise a container bottom having a central container aperture formed therein.

In accordance with yet another embodiment, the pod housing can comprise a housing bottom having a central housing aperture formed therein.

In accordance with another embodiment, the dispensing mechanism can further comprise a threaded shaft received in both the container aperture and the housing aperture, the threaded shaft defining a vertical axis.

In accordance with a further embodiment, the threaded shaft can have a first end extending in the pod housing and a second end extending past the container bottom.

In accordance with yet another embodiment, the housing aperture can define an internal threaded surface and the threaded shaft can comprise an elongated main body defining an external threaded surface. The external threaded surface of the elongated main body can be in threaded engagement with the internal threaded surface of the housing aperture.

In accordance with another embodiment, the threaded shaft can further comprise a holder interface portion at the first end of the elongated main body to support the pod holder in the pod housing.

In accordance with a further embodiment, the dispensing mechanism can further comprise an actuator at the second end of the threaded shaft configured to provide rotation to the threaded shaft about the vertical axis.

In accordance with yet another embodiment, the actuator can be releasably coupled to the second end of the threaded shaft.

In accordance with a further embodiment, the pod housing is constrained from rotation within the base container upon rotation of the threaded shaft, thereby allowing the pod housing to travel up and down on the threaded shaft upon rotation of the actuator.

In accordance with yet another embodiment, upon rotation of the threaded shaft about the vertical axis in a first rotation direction, the pod housing can retract within the base container as the pod holder is constrained from rotation within the pod housing and remains stationary relative to the base container, thereby allowing the upper portion of the pod to extend through the opened top of the pod housing.

In accordance with another embodiment, upon rotation of the threaded shaft about the vertical axis in a second rotation direction, the pod housing can gradually exit from the base container as the pod holder is constrained from rotation within the pod housing and remains stationary relative to the base container.

In accordance with a further embodiment, the base container can comprise a container body for receiving the pod housing therein, and a cap releasably securable to the container body.

In accordance with yet another embodiment, the pod housing can comprise a housing body for receiving the pod therein, and a pod securing member releasably securable to the housing body.

In accordance with another embodiment, the pod securing member can define an inner surface with at least one gripping protrusion outwardly extending therefrom, configured to prevent displacement of the pod relative to the pod housing.

In accordance with a further embodiment, the surface area defined by the base container can substantially correspond to the surface area defined by the pod housing, thereby preventing the pod housing from rotating about the vertical axis upon rotation of the threaded shaft.

In accordance with yet another embodiment, the surface area defined by the pod holder can substantially correspond to the surface area defined by the pod housing, thereby preventing the pod holder from rotating about the vertical axis upon rotation of the threaded shaft.

In accordance with another embodiment, the pod holder can define a pod support surface for supporting the pod holder thereon within the pod housing.

In accordance with a further embodiment, the holder interface portion of the threaded shaft can be rotatably coupled with a lower section of the pod holder.

In accordance with yet another embodiment, the actuator can comprise an actuator main body and a shaft receiving aperture formed therein, the shaft receiving aperture defining an internal threaded surface.

In accordance with another embodiment, the elongated main body of the threaded shaft can comprise a shaft first section defining a first external threaded surface for threaded engagement with the threaded surface of the housing aperture, and a shaft second section defining a second external threaded surface for threaded engagement with the internal threaded surface of the shaft receiving aperture.

In accordance with a further embodiment, the pod can be made of a solid material.

In accordance with yet another embodiment, the pod can be made of a gel material.

In accordance with another embodiment, the pod can be a deodorant pod, an antiperspirant pod, a sunscreen pod, lipstick or a lip balm pod.

In accordance with a further embodiment, there is provided a method for dispensing a consumable pod from a refillable dispenser comprising a base container, and a pod housing vertically displaceable therein, the method comprising: providing the pod housing in an uppermost configuration wherein an upper portion of the pod extends through an opened top of the pod housing; and gradually lowering the pod housing relative to the base container as the pod is consumed to keep the upper portion of the pod extending through the opened top of the pod housing.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

Figure 1:
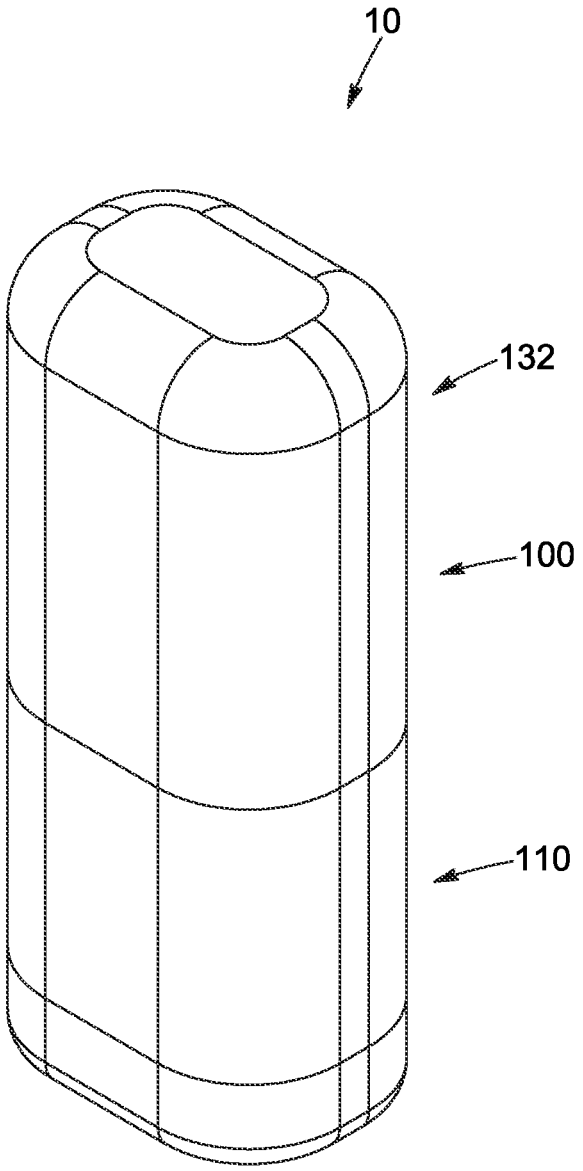
FIG. 1 is a top perspective view of a refillable dispenser in accordance with an embodiment.

In the following description, the same numerical references refer to similar elements. Furthermore, for the sake of simplicity and clarity, namely so as to not unduly burden the figures with several reference numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures or described in the present disclosure are embodiments only, given solely for exemplification purposes.

Furthermore, in the context of the present description, it will be considered that all elongated objects will have an implicit "longitudinal axis" or "centerline", such as the longitudinal axis of a shaft for example, or the centerline of a biasing device such as a coiled spring, for example, and that expressions such as "connected" and "connectable", or "mounted" and "mountable", may be interchangeable, in that the present refillable dispenser also relates to kits with corresponding components for assembling a resulting fully-assembled and fully-operational refillable dispenser.

It is appreciated that even though the accompanying drawings illustrate a refillable deodorant or antiperspirant dispenser configured to receive a consumable deodorant or antiperspirant pod that can be gradually consumed during use, the refillable dispenser can be shaped, sized and configured so as to receive any refill pod and dispense the same. For example, a person skilled in the art to which the refillable dispenser described herein pertains would understand that the refillable dispenser can be shaped, sized and configured so as to receive any refill pods such as, without limitations, sunscreen refill pods, lipstick refill pods, lip balm refill pods, any cosmetic, pharmaceutical or hygienic product refill pods, and the like.

Moreover, components of the present refillable dispenser and/or steps of the method(s) described herein could be modified, simplified, altered, omitted and/or interchanged, without departing from the scope of the present disclosure, depending on the particular applications which the refillable dispenser is intended for, and the desired end results, as briefly exemplified herein and as also apparent to a person skilled in the art.

In addition, although the embodiments as illustrated in the accompanying drawings comprise various components, and although the embodiments of the present refillable dispenser and corresponding portion(s)/part(s)/component(s) as shown consist of certain geometrical configurations, as explained and illustrated herein, not all of these components and geometries are essential and thus should not be taken in their restrictive sense, i.e. should not be taken so as to limit the scope of the present disclosure. It is to be understood, as also apparent to a person skilled in the art, that other suitable components and cooperation thereinbetween, as well as other suitable geometrical configurations may be used for the present refillable dispenser and corresponding portion (s)/part(s)/component(s) according to the present refillable dispenser, as will be briefly explained herein and as can be easily inferred herefrom by a person skilled in the art, without departing from the scope of the present disclosure.

To provide a more concise description, some of the quantitative and qualitative expressions given herein may be qualified with the terms "about" and "substantially". It is understood that whether the terms "about" and "substantially" are used explicitly or not, every quantity or qualification given herein is meant to refer to an actual given value or qualification, and it is also meant to refer to the approximation to such given value or qualification that would reasonably be inferred based on the ordinary skill in the art, including approximations due to the experimental and/or measurement conditions for such given value.

The present disclosure describes a refillable, and thus reusable, dispenser which is configured so as to allow an end user or consumer to refill the dispenser with a new pod instead of disposing of the whole dispenser and which, by virtue of its design and components, overcomes or at least minimizes some of the above-discussed drawbacks.

Referring now the drawings and more particularly to the non-limitative embodiment of FIGS. 1 to 3, 11 and 12, there is shown a refillable dispenser (10) for receiving consumable pods (not shown) that can be gradually consumed during use. As mentioned above, the refillable dispenser (10) can be configured so as to receive any refill pod, such as deodorant pods, antiperspirant pods, or any other product pod that can be consumed.

The refillable dispenser (10) includes a base container (100) and a pod housing (200), which defines an opened top (222). The pod housing (200) is shaped, sized and configured so as to receive the pod therein, and is vertically displaceable within the base container (100). The refillable dispenser (10) further includes a dispensing mechanism (300) for moving the pod housing (200) relative to the base container (100) between an uppermost configuration (FIG. 11) and a lowermost configuration (FIG. 12), while maintaining the pod stationary relative to the base container (100). As it will be described in more details below, lowering the pod housing (200) relative to the base container (100) as the pod is consumed causes an upper portion of the pod to extend through the opened top (222) of the pod housing (200). Therefore, in the uppermost configuration, a new pod introduced within the pod housing (200) has the upper portion which extends through the opened top (222) of the pod housing (200) and can be dispensed therefrom. In other words, when the pod housing (200) is configured in the uppermost configuration (FIG. 11), the pod has been dispensed from the dispenser by a small to no amount. On the other hand, in the lowermost configuration, an almost fully consumed pod can be removed from the pod housing (200), or alternatively, the pod has been fully consumed. The pod housing (200) is configured so as to receive and dispense pod refills, such that when the pod is depleted or fully consumed, a new pod can be received within the pod housing (200) and dispensed therefrom.

Now referring more particularly to FIGS. 2, 3 and 4A to 4F, the pod housing (200) includes a housing body (212), which is shaped, sized and configured so as to receive the pod therein. The housing body (212) defines a housing bottom (214) which defines a periphery, and sidewalls (216) which upwardly extend from the periphery of the housing bottom (214). The pod housing (200) also includes a central housing aperture (228) formed in the housing bottom (214), which defines an internal threaded surface (229). The central housing aperture 228 can also be referred to as a "threaded" central housing aperture. The housing body (212) further includes a lower edge (220) and an upper edge (218), which is found opposite to the lower edge (220). The housing body (212) further defines an interior (230) which is shaped, sized and configured so as to receive the pod therein and to maintain its integrity while the pod housing (200) is vertically displaced within the base container (100) between its uppermost configuration and its lowermost configuration, or alternatively, between its lowermost configuration and its uppermost configuration. The housing body (212) further defines an inner surface (224), an outer surface (226), which is found opposite to the inner surface (224), as well as a lip (232), at or near the upper edge (218).

Now referring more particularly to FIGS. 1 to 3, 5A to 5F and 9A to 9D, the base container (100) includes a container body (110), which is shaped, sized and configured so as to receive the pod housing (200), and a cap (132), which can be releasably secured to the container body (110). The container body (110) defines a container bottom (112) which defines a periphery, and sidewalls (114) which upwardly extend from the periphery of the container bottom (112). The container bottom (112) also includes a central container aperture (128) formed therein, which is unthreaded. The container body (110) further includes a lower edge (118) and an upper edge (116), which is found opposite to the lower edge (118). The container body (110) further defines an opened top (120) and an interior (130) which is shaped, sized and configured so as to receive the pod housing (200) therein and allow its vertical displacement. The container body (110) further defines an inner surface (124), an outer surface (126), which is found opposite to the inner surface (124), as well as a lip (122), at or near the upper edge (116). On the other hand, the cap (132) defines an outer surface (134), an inner surface (136), which is found opposite the outer surface (134), as well as a lower edge (138), which can be supported by the lip (122) once the cap 132 is releasably secured to the container body (110). Corresponding protrusions and/or apertures can be provided on the inner surface (136) of the cap (132) about its lower edge (138) and/or on the outer surface (126) of the container body (110) about its upper edge (116) to ensure the required connection between the cap (132) and the container body (110) is provided.

Figure 11:
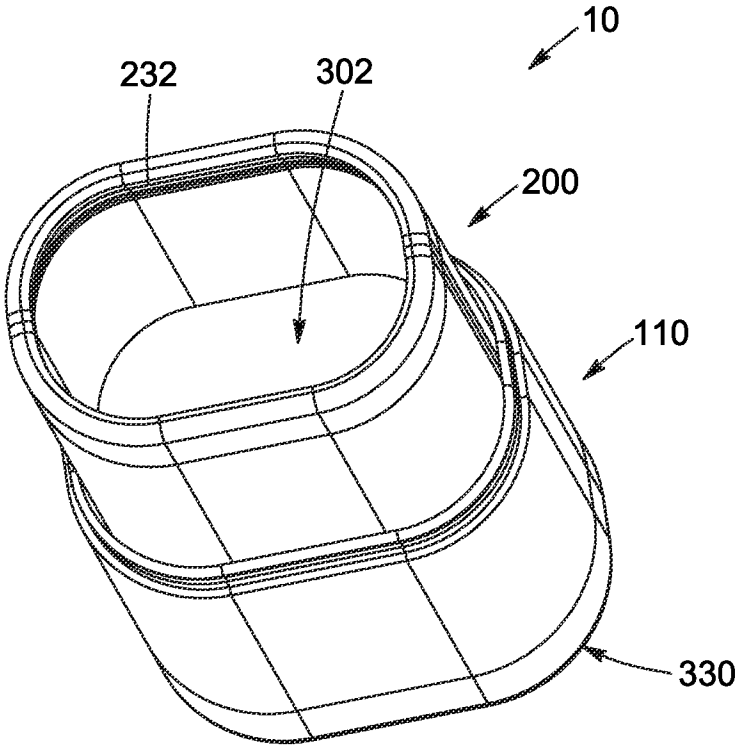
FIG. 11 is a top perspective view of the refillable dispenser of FIGS. 2 and 3, where the pod housing is configured in the uppermost configuration, so that a new pod introduced within the pod housing can have its upper portion extending through the opened top of the pod housing and can be dispensed therefrom.
Figure 12:
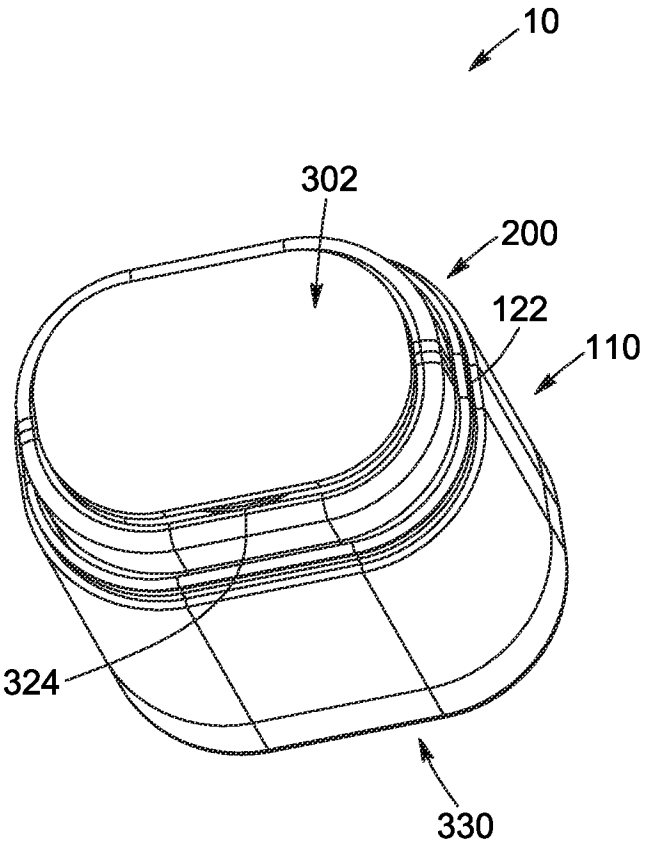
FIG. 12 is a top perspective view of the refillable dispenser of FIGS. 2 and 3, where the pod housing is configured in the lowermost configuration, so that an almost fully consumed pod can be removed from the pod housing or the pod can be fully consumed.

Now referring to FIGS. 2, 3, 6A to 6E, 8A to 8E and 10A to 10D, there is shown in more details the dispensing mechanism (300). The dispensing mechanism (300) includes a pod holder (302) (FIGS. 2, 3 and 8A to 8E) within the pod housing (200) for supporting the pod, and is configured to maintain the pod substantially stationary relative to the base container (100) (i.e., no vertical displacement of the pod holder (302) upon actuation of the dispensing mechanism (300)) as the pod housing (200) is displaced within the base container (100) between the uppermost configuration (FIG. 11) and the lowermost configuration (FIG. 12). The pod holder (302) defines a pod support surface or upper surface (304) which is shaped, sized and configured so as to support the pod thereon within the housing body (212) of the pod housing (200).

Figure 2:
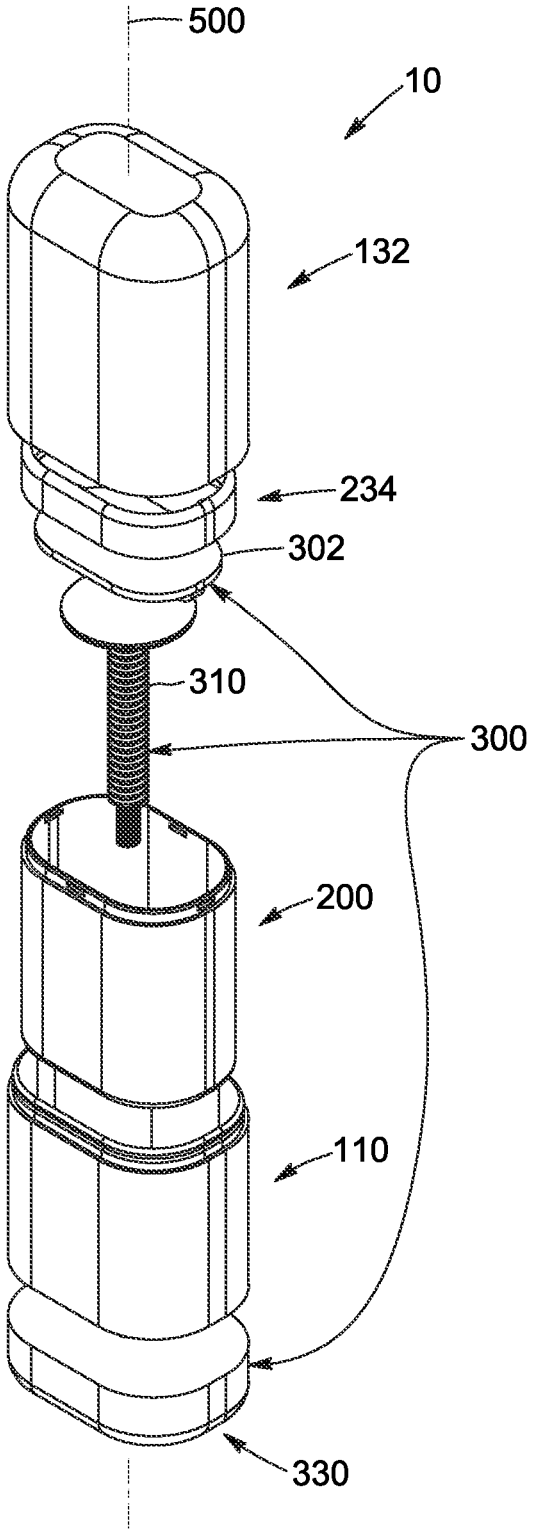
FIG. 2 is an exploded top perspective view of the refillable dispenser of FIG. 1.
Figure 3:
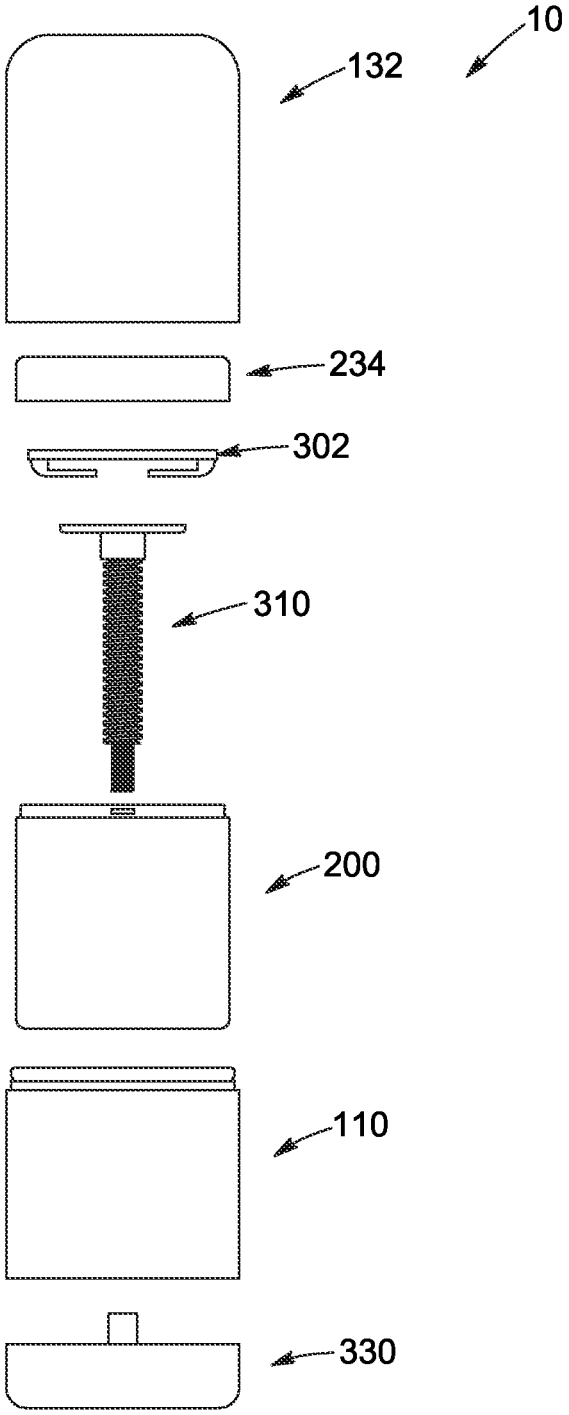
FIG. 3 is a front elevation exploded view of the refillable dispenser of FIG. 1.
Figure 4B:
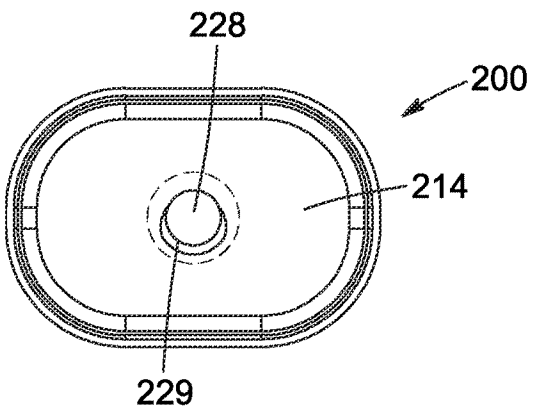
FIG. 4B is a top plan view of the pod housing of FIG. 4A.
Figure 4C:
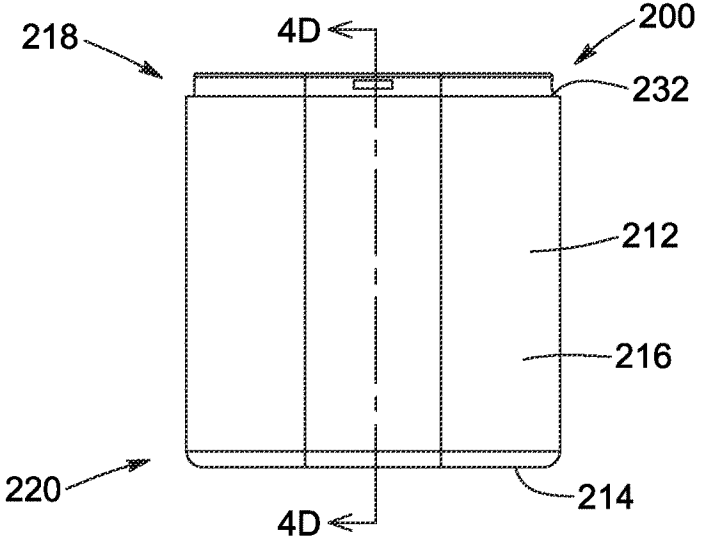
FIG. 4C is a front elevation view of the pod housing of FIG. 4A.
Figure 4A:
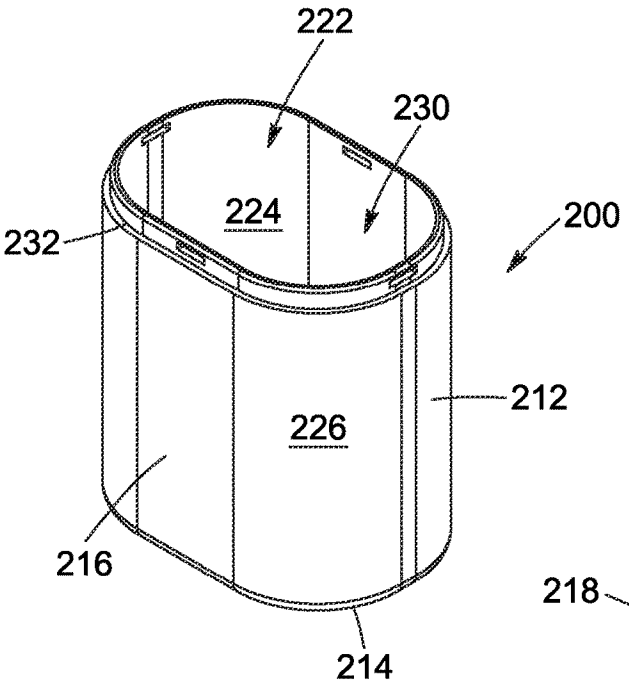
FIG. 4A is a top perspective view of a pod housing of the refillable dispenser shown in FIGS. 2 and 3.
Figure 4E:
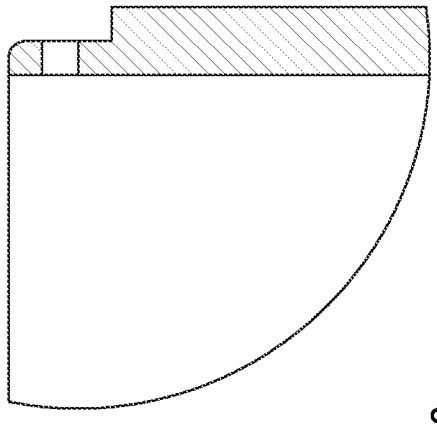
FIG. 4E is a closed-up view of an upper edge of the pod housing of FIG. 4D.
Figure 4F:
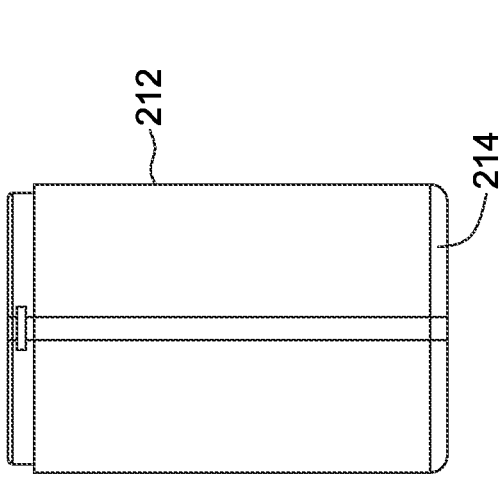
FIG. 4F is a side elevation view of the pod housing of FIG. 4A.
Figure 4D:
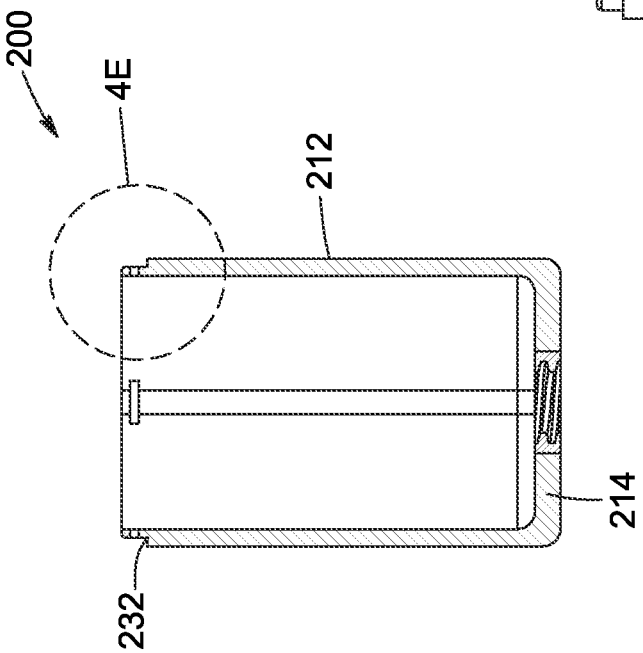
FIG. 4D is a cross-sectional view taken along line 4D-4D of the pod housing of FIG. 4C.
Figure 5B:
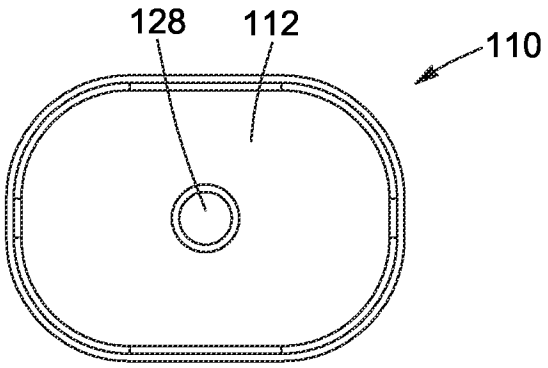
FIG. 5B is top plan view of the container body of FIG. 5A.
Figure 5C:
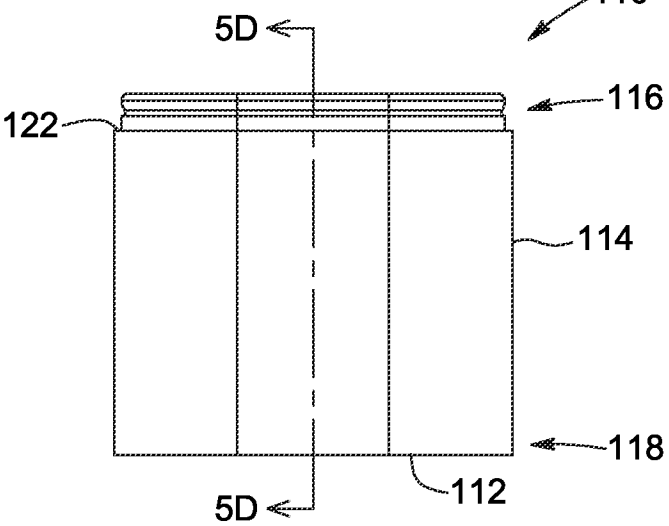
FIG. 5C is a front elevation view of the container body of FIG. 5A.
Figure 5A:
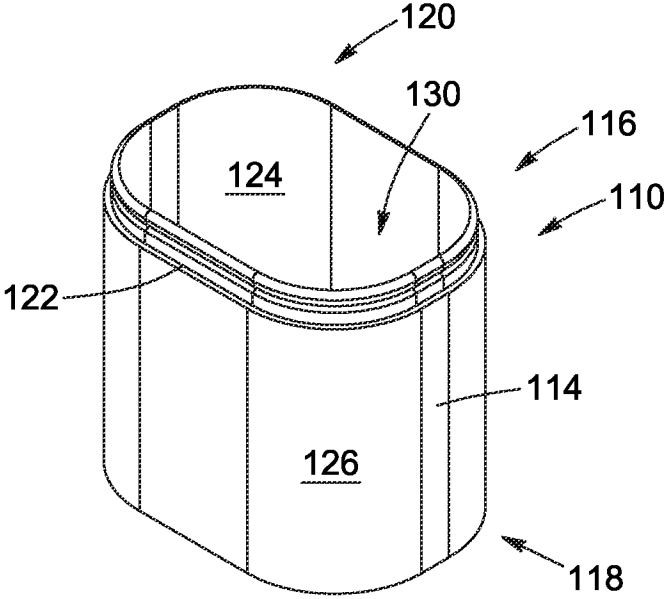
FIG. 5A is a top perspective view of a container body of the refillable dispenser shown in FIGS. 2 and 3.
Figure 5E:
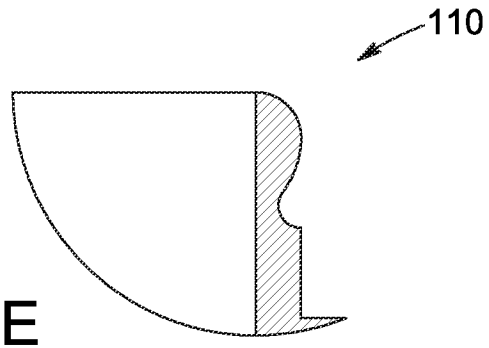
FIG. 5E is a closed-up view of an upper edge of the container body of FIG. 5D.
Figure 5F:
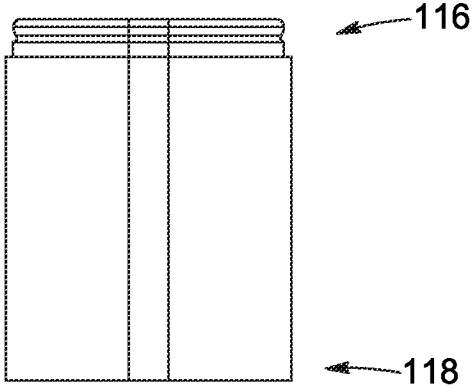
FIG. 5F is a side elevation view of the container body of FIG. 5A.
Figure 5D:
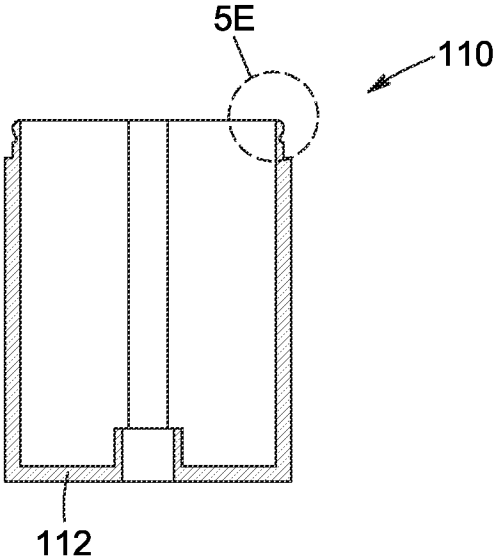
FIG. 5D is a cross-sectional view taken along line 5D-5D of the container body of FIG. 5C.
Figure 6B:
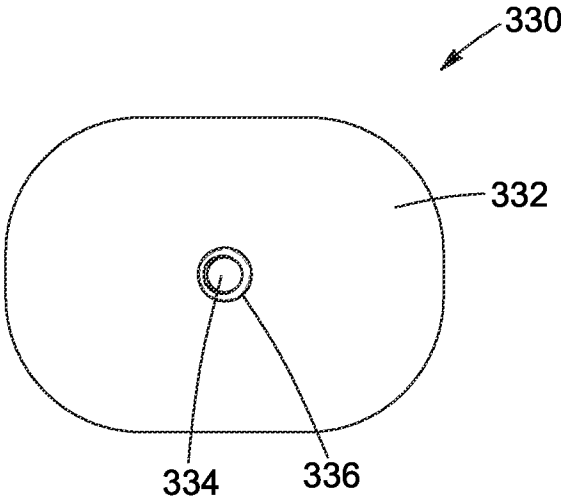
FIG. 6B is a top plan view of the actuator of FIG. 6A.
Figure 6C:
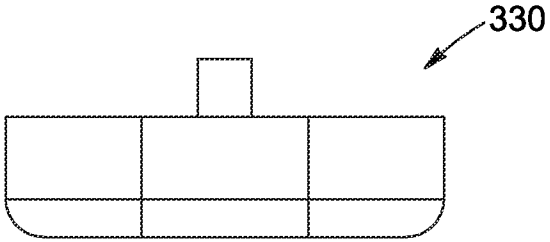
FIG. 6C is a front elevation view of the actuator of FIG. 6A.
Figure 6A:
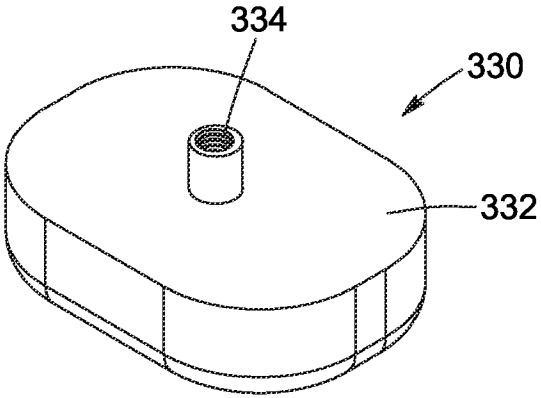
FIG. 6A is a top perspective view of an actuator of the refillable dispenser shown in FIGS. 2 and 3.
Figure 6E:
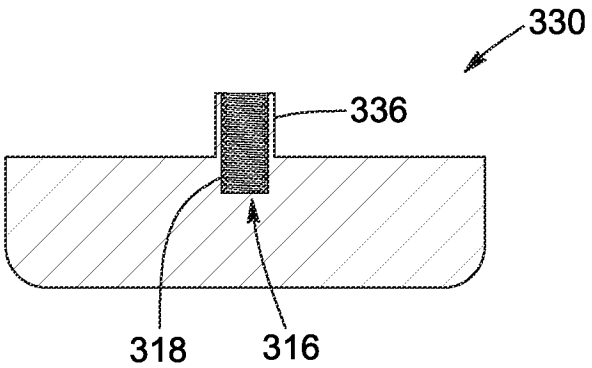
FIG. 6E is a cross-sectional view taken along line 6E-6E of the actuator of FIG. 6D, where a threaded shaft is shown in threaded engaged with the internal threaded surface defined by a shaft receiving aperture formed in the actuator main body.
Figure 6D:
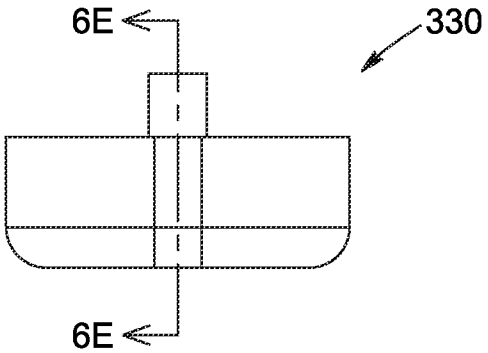
FIG. 6D is a side elevation view of the actuator of FIG. 6A.
Figure 7A:
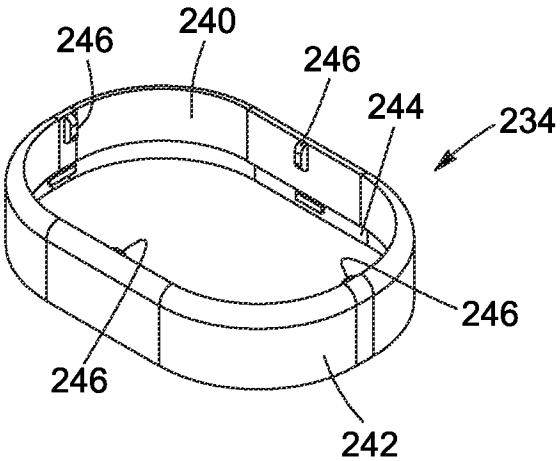
FIG. 7A is a top perspective view of a pod securing member of the refillable dispenser shown in FIGS. 2 and 3.
Figure 7C:
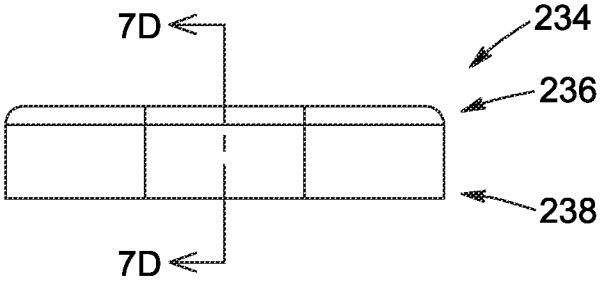
FIG. 7C is a front elevation view of the pod securing member of FIG. 7A.
Figure 7D:
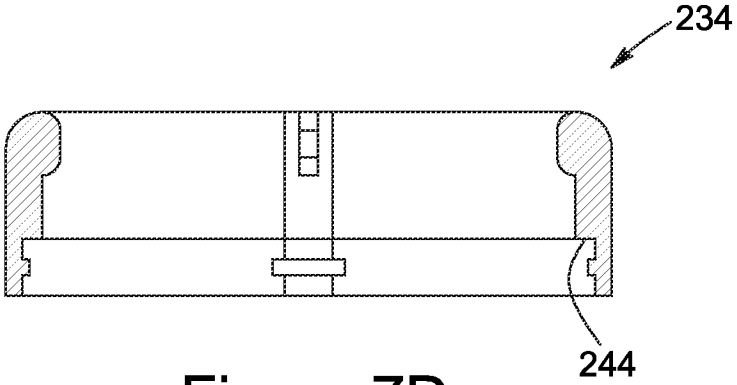
FIG. 7D is a cross-sectional view taken along line 7D-7D of the pod securing member of FIG. 7C.
Figure 7B:
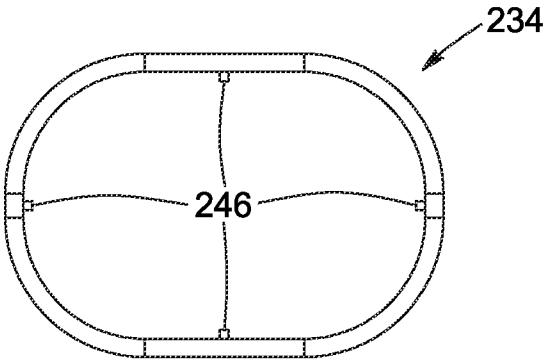
FIG. 7B is a top plan view of the pod securing member of FIG. 7A.
Figure 8B:
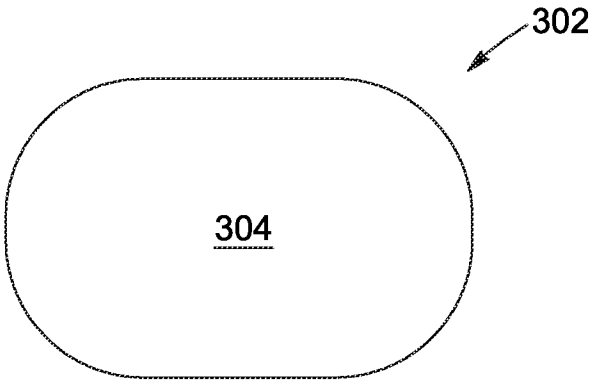
FIG. 8B is a top plan view of the pod holder of FIG. 8A.
Figure 8A:
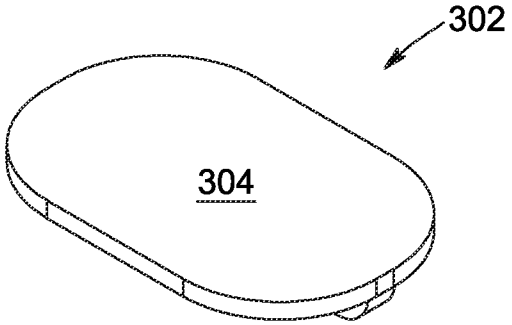
FIG. 8A is a top perspective view of a pod holder of the refillable dispenser shown in FIGS. 2 and 3.
Figure 8C:
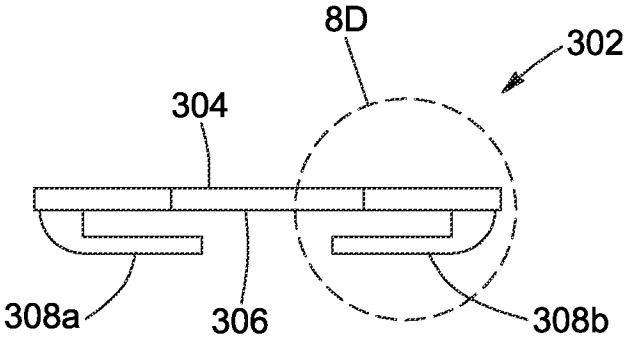
FIG. 8C is a front elevation view of the pod holder of FIG. 8A.
Figure 9A:
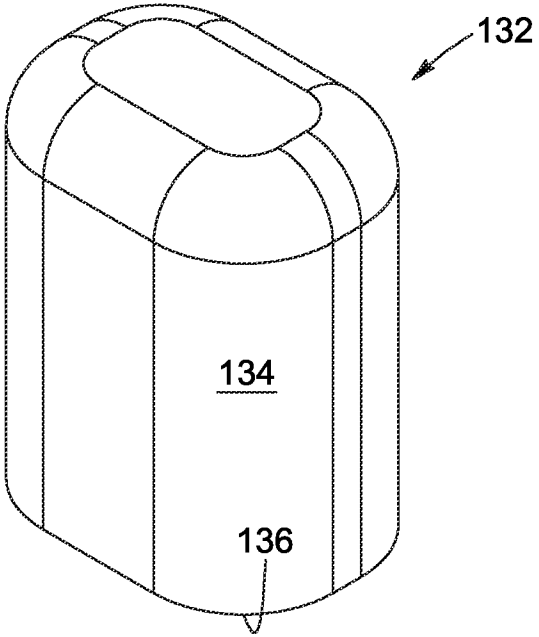
FIG. 9A is a top perspective view of a cap of the refillable dispenser shown in FIGS. 2 and 3.
Figure 8D:
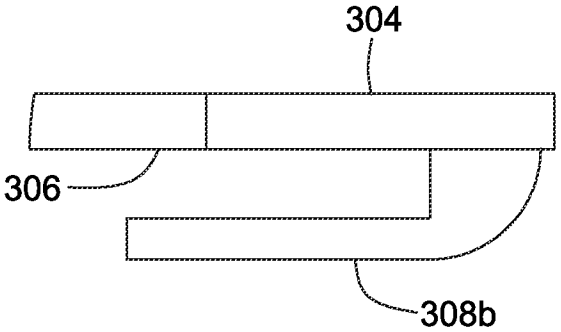
FIG. 8D is a closed-up view of the pod holder of FIG. 8C.
Figure 8E:
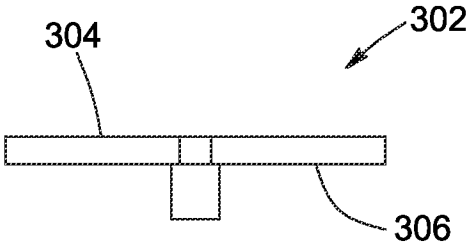
FIG. 8E is a side elevation view of the pod holder of FIG. 8A.
Figure 9B:
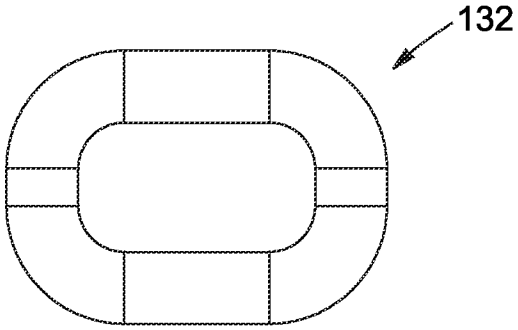
FIG. 9B is a top plan view of the cap of FIG. 9A.
Figure 9D:
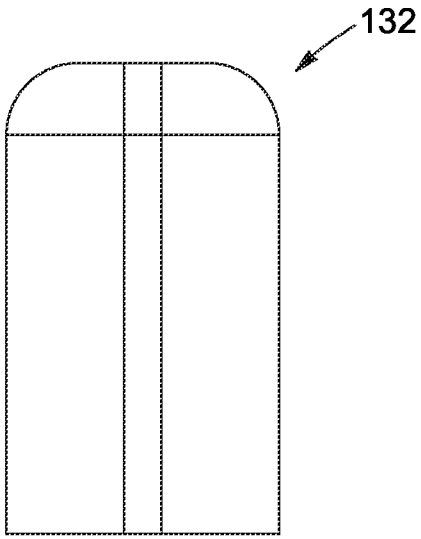
FIG. 9D is a side elevation view of the cap of FIG. 9A.
Figure 9C:
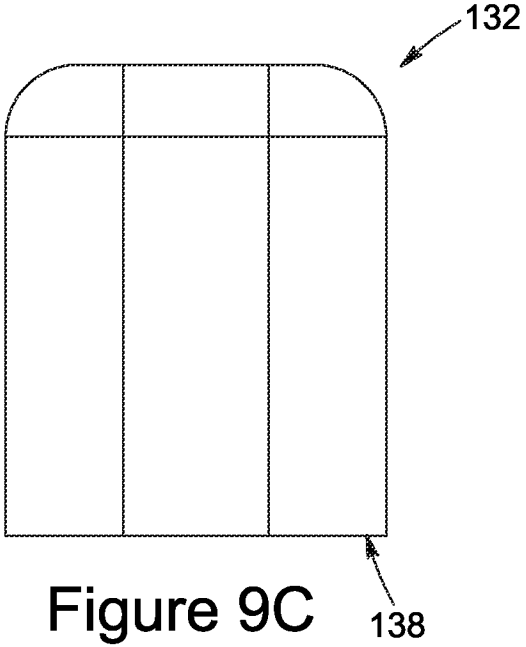
FIG. 9C is a front elevation view of the cap of FIG. 9A.
Figure 10C:
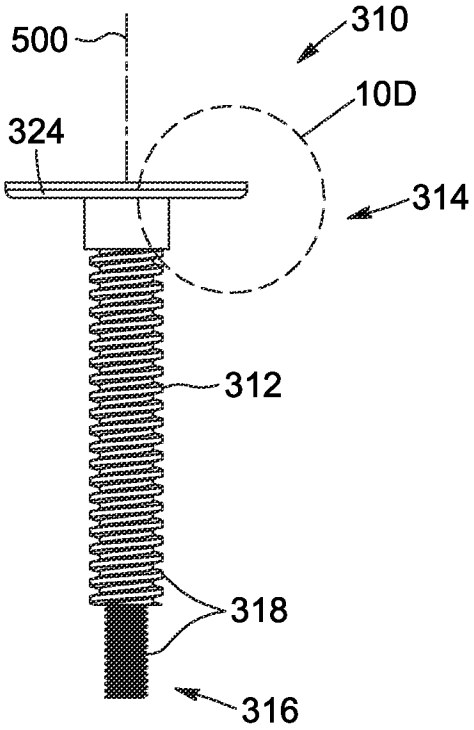
FIG. 10C is an elevation view of the threaded shaft of FIG. 10A.
Figure 10B:
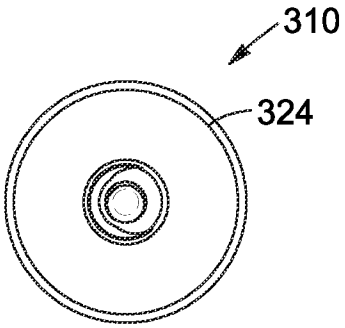
FIG. 10B is bottom plan view of the threaded shaft of FIG. 10A.
Figure 10A:
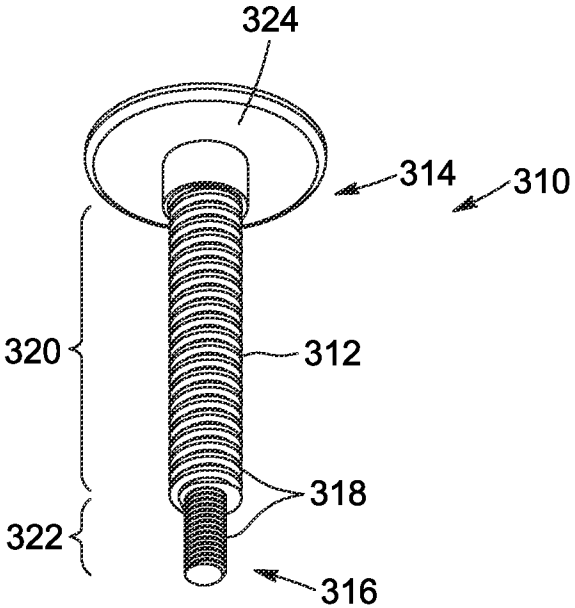
FIG. 10A is a bottom perspective view of a threaded shaft of the refillable dispenser shown in FIGS. 2 and 3.
Figure 10D:
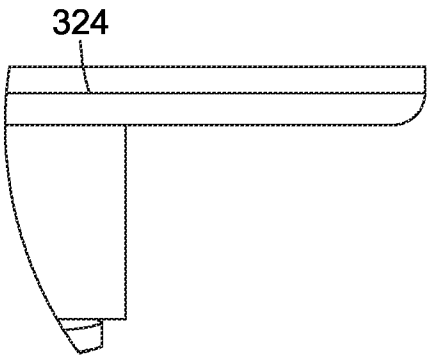
FIG. 10D is a closed-up view of a holder interface portion of the threaded shaft shown in FIG. 10C.

The dispensing mechanism (300) further includes a threaded shaft (310) (FIGS. 2, 3 and 10A to 10D) which is shaped, sized and configured so as to be received in both the container aperture (128) and the housing aperture (228). The threaded shaft (310) defines a vertical axis (500) (FIGS. 2 and 10C). The threaded shaft (310) includes an elongated main body (312) which has a first end (314) which extends in the pod housing (200) and a second end (316) which extends past the container bottom 112 (FIGS. 11 and 12). The elongated main body (312) defines an external threaded surface (318), which is in threaded engagement with the internal threaded surface (229) of the housing aperture (228). The threaded shaft (310) further includes a holder interface portion (324) at the first end (314) of the elongated main body (312) to support the pod holder (302) in the pod housing (200). The holder interface portion (324) of the threaded shaft (310) is rotatably coupled with a lower section (306) of the pod holder (302).

Indeed, the pod holder (302) defines a threaded shaft interfacing surface or lower section (306) which is shaped, sized and configured so as to interface with the holder interface portion (324) of the threaded shaft (310) and includes protrusions (308*a*, 308*b*), which downwardly extends from the threaded shaft interfacing surface (306). Main purpose of the protrusions (308*a*, 308*b*) is to form a spacing to rotatably and releasably receive the holder interface portion (324) of the threaded shaft (310) so the threaded shaft (310) can rotate about the vertical axis (500), while preventing the pod holder (302) from rotating within the pod housing (200) (i.e., the holder interface portion (324) rotates about vertical axis (500) in the spacing formed by the protrusions (308*a*, 308*b*)). Protrusions (308*a*, 308*b*) can thus be referred to as shaft retaining protrusions. A person skilled in the art to which the refillable dispenser (10) pertains would however understand that the pod holder (302) and the holder interface portion (324) can take any shape, size and configuration, as long as it allows rotation of the holder interface portion (324) relative to the pod holder (302) and it support the same within the pod housing (200). Indeed, in some implementations, the pod holder (302) can take the form of a plate which defines a surface area which corresponds to the surface area of the pod housing (200). In other implementations, the holder interface portion (324) can take the form of a rounded member or articulation member which can be rotatably secured to a recess portion provided on the lower surface or section (306) of the pod holder (302), so that, upon rotation of the threaded shaft (310) and therefore, of the holder interface portion (324), the pod holder (302) remains stationary relative to the base container (100) (i.e., no vertical displacement relative to the container body (110), no rotational movement relative to the pod housing (200) and the container body (110)).

Now referring more particularly to FIGS. 1, 2, 3 and 6A to 6E, the dispensing mechanism (300) further includes an actuator (330) at the second end (316) of the threaded shaft (310). The actuator (330) is configured so as to provide rotation to the threaded shaft (310) about the vertical axis (500). The actuator (330) is releasably coupled to the second end (316) of the threaded shaft (310). The actuator (330) includes an actuator main body (332) and a shaft receiving aperture (334) formed therein. The shaft receiving aperture (334) defines an internal threaded surface (336).

The elongated main body (312) of the threaded shaft (310) includes a shaft first section (320), which defines a first external threaded surface for threaded engagement with the internal threaded surface (229) of the housing aperture (228), and a shaft second section (322), which defines a second external threaded surface for threaded engagement with the internal threaded surface (336) of the shaft receiving aperture (334) found in the actuator main body (332). It is however noted that the actuator (330) can be coupled to the second end (316) of the threaded shaft (310) using other connection means, as long as the actuator (330) can provide rotation to the threaded shaft (310) about the vertical axis (500). For example, the actuator (330) can be coupled to the second end (316) of the threaded shaft using pin-like members or clips which prevent the actuator (330) to rotate relative to the threaded shaft (310) and vice versa.

Thanks to the configuration of the refillable dispenser (10), upon rotation of the threaded shaft (310), the pod housing (200) is constrained from rotation within the base container (100), allowing the pod housing (200) to travel up and down on the threaded shaft (310) upon rotation of the actuator (330). In other words, upon rotation of the threaded shaft (310) about the vertical axis (500) in a first rotation direction, the pod housing (200) moves downwardly relative to the base container (or retracts) within the base container (100) as the pod holder (302) is constrained from rotation within the pod housing (200) and remains stationary relative to the base container (100), allowing the upper portion of the pod (not shown) to extend through the opened top (222) of the pod housing (200). On the other hand, upon rotation of the threaded shaft (310) about the vertical axis (500) in a second rotation direction (i.e., opposite the first rotation direction), the pod housing (200) can move upwardly, away from the base container so as to gradually exit from the base container (100) (i.e., from the container body (110)) as the pod holder (302) is constrained from rotation within the pod housing (200) and remains stationary relative to the base container (100).

The surface area defined by the base container (100) (i.e., by the container body (110) of the base container (100)) substantially corresponds to the surface area defined by the pod housing (200) (i.e., the housing body (212) of the pod housing (200)), so as to prevent the pod housing (200) from rotating about the vertical axis (500) upon rotation of the threaded shaft (310). Similarly, the surface area defined by the pod holder (302) substantially corresponds to the surface area defined by the pod housing (200) (i.e., the housing body (212) of the pod housing (200)), so as to prevent the pod holder (302) from rotating about the vertical axis (500) upon rotation of the threaded shaft (310).

Now referring more particularly to FIGS. 2, 3 and 7A to 7D, the pod housing (200) further includes a pod securing member (234) which is releasably securable to the housing body (212). The pod securing member (234) defines an upper edge (236), a lower edge (238), an outer surface (242) and an inner surface (240) with gripping protrusions (246) which outwardly extends therefrom. The gripping protrusions (246) are shaped, sized and configured so as to prevent displacement of the pod relative to the housing body 212 of the pod housing (200). The pod securing member (234) is shaped, sized and configured so as to be releasably secured to or coupled with the upper edge (218) of the housing body (212). The pod securing member (234) also includes a lip (244), which can interact with the lip (232) of the housing body (212). Recesses and/or corresponding protrusions can also be provided at or near the upper edge (218) of the housing body (212) and/or at or near the lower edge (238) of the pod securing member (234) so that the pod securing member (234) can be secured with the housing body (212) to ensure the required connection between the pod securing member 234 (234) and the housing body (212) is provided.

Since the pod is supported by the pod holder (302) and remains substantially static relative to the base container (100), the pod does not need to be integrated with a pod support, reducing the manufacturing costs and most importantly, the wastes, so as to present an ecological refillable dispenser.

In some implementations, the base container (100), the pod housing (200) and/or the dispensing mechanism (300) can be made of, without limitation, a metallic material (e.g., stainless steel), a plastic material, and the like. The outer surfaces (126), (134) of the container body (110) and the cap (132) can further include particular colours, designs and/or ornamentation.

In some implementations, the pod can be made of a solid material, while in some other implementations, the pod can be made of a gel material. The pod can also come in a wrapping protection. As mentioned above, a person skilled in the art to which the refillable dispenser (10) pertains would understand that the refillable dispenser (10) can take any shape, size or configuration, so as to receive a pod which can be, without limitation, a deodorant pod, an antiperspirant pod, a sunscreen pod, a lipstick pod, a lip balm pod, and the like. Indeed, the base container (100), the pod housing (200) and the pod holder (302) can take any shape, size and/or configuration, as long as it allows the pod housing (200) to move up and down within the base container (100), while maintaining the pod substantially stationary relative to the base container (100).

In accordance with a non-limitative embodiment, there is also provided a method for dispensing a consumable pod from a refillable dispenser, such as the refillable dispenser (10) described above, which includes a base container (e.g., base container (100)), and a pod housing (e.g., pod housing (200)) which is vertically displaceable therein. The method includes a step of providing the pod housing (200) in an uppermost configuration, where an upper portion of the pod extends through an opened top (222) of the pod housing (200). The method further includes a step of gradually lowering the pod housing (200) relative to the base container (100) (e.g., within the base container (100)) as the pod is consumed to keep the upper portion of the pod extending through the opened top (222) of the pod housing (200). When the pod is almost fully consumed, the method can also include the steps of releasing a pod securing member (e.g., pod securing member (234)) from a housing body (212) of the pod housing (200), filling the pod housing (200) with a new pod with its upper portion extending though the opened top of the pod housing (200), and securing back the pod securing member (234) containing the almost fully consumed pod to the housing body (212) of the pod housing (200) so that the almost fully consumed pod can be compacted during use with the new pod so as to leave no waste behind.

The container body (110), the cap (132), the pod housing (200), the pod holder (302), the threaded shaft (310) and/or the actuator (330) can easily be assembled and disassembled so that the parts can be washed periodically.

According to the configuration of the dispenser (10), and more particularly of the pod housing (200) and the pod holder (302), the pod is further prevented from rotating when the pod housing (200) is displaced in the base container (100) between the uppermost configuration and the lowermost configuration. The surface area defined by both the pod housing (200) and the pod holder (302) can take any shape, size and/or configuration.

Although the present invention has been described hereinabove by way of specific embodiments thereof, it can be modified, without departing from the spirit and nature of the subject invention defined in the appended claims.

The invention claimed is:

1. A refillable dispenser for receiving consumable pods that are gradually consumed during use, comprising:

a base container comprising a container bottom having an unthreaded central container aperture formed therein;

a pod housing, defining an opened top, for receiving a pod therein, and comprising a housing bottom having a threaded central housing aperture formed therein, the pod housing being vertically displaceable within the base container; and a dispensing mechanism for moving the pod housing relative to the base container between an uppermost configuration and a lowermost configuration, while being adapted to maintain the pod stationary relative to the base container, the dispensing mechanism comprising a threaded shaft defining a vertical axis and received in both the container aperture and the housing aperture, wherein lowering the pod housing relative to the base container as the pod is consumed causes an upper portion of the pod to extend through the opened top of the pod housing;

wherein in the uppermost configuration, a new pod able to be introduced within the pod housing has the upper portion extending through the opened top of the pod housing and is able to be dispensed therefrom;

wherein in the lowermost configuration, an almost fully consumed pod is removable from the pod housing; and wherein the dispensing mechanism comprises a pod holder within the pod housing for supporting the pod, the dispensing mechanism being configured to maintain the pod holder stationary relative to the base container as the pod housing is displaced within the base container between the uppermost configuration and the lowermost configuration.

2. The refillable dispenser of claim 1, wherein the threaded shaft has a first end extending in the pod housing and a second end extending past the container bottom.

3. The refillable dispenser of claim 2, wherein the housing aperture defines an internal threaded surface and the threaded shaft comprises an elongated main body defining an external threaded surface, the external threaded surface of the elongated main body being in threaded engagement with the internal threaded surface of the housing aperture.

4. The refillable dispenser of claim 3, wherein a surface area defined by the pod holder substantially corresponds to a surface area defined by the pod housing, thereby preventing the pod holder from rotating about the vertical axis upon rotation of the threaded shaft.

5. The refillable dispenser of claim 4, wherein the pod holder defines a pod support surface for supporting the pod thereon within the pod housing.

6. The refillable dispenser of claim 3, wherein the elongated main body of the threaded shaft comprises a shaft first section defining a first external threaded surface for threaded engagement with the threaded surface of the housing aperture, and a shaft second section defining a second external threaded surface for threaded engagement with the internal threaded surface of the shaft receiving aperture.

7. The refillable dispenser of claim 3, wherein the threaded shaft further comprises a holder interface portion at the first end of the elongated main body to support the pod holder in the pod housing.

8. The refillable dispenser of claim 7, wherein the holder interface portion of the threaded shaft is rotatably coupled with a lower section of the pod holder.

9. The refillable dispenser of claim 7, wherein the dispensing mechanism further comprises an actuator at the second end of the threaded shaft for rotating the threaded shaft about the vertical axis.

10. The refillable dispenser of claim 9, wherein the actuator comprises an actuator main body and a shaft receiving aperture formed therein, the shaft receiving aperture defining an internal threaded surface.

11. The refillable dispenser of claim 9, wherein the actuator is releasably coupled to the second end of the threaded shaft.

12. The refillable dispenser of claim 1, wherein the pod housing is constrained from rotation within the base container upon rotation of the threaded shaft, thereby allowing the pod housing to travel up and down on the threaded shaft upon rotation of the actuator.

13. The refillable dispenser of claim 1, wherein upon rotation of the threaded shaft about the vertical axis in a first rotation direction, the pod housing retracts within the base container as the pod holder is constrained from rotation within the pod housing and remains stationary relative to the base container, thereby allowing the upper portion of the pod to extend through the opened top of the pod housing.

14. The refillable dispenser of claim 13, wherein upon rotation of the threaded shaft about the vertical axis in a second rotation direction, the pod housing gradually exits from the base container as the pod holder is constrained from rotation within the pod housing and remains stationary relative to the base container.

15. The refillable dispenser of claim 1, wherein the base container comprises a container body for receiving the pod housing therein, and a cap releasably securable to the container body.

16. The refillable dispenser of claim 1, wherein the pod housing comprises a housing body for receiving the pod therein, and a pod securing member releasably securable to the housing body.

17. The refillable dispenser of claim 16, wherein the pod securing member defines an inner surface with at least one gripping protrusion outwardly extending therefrom, configured to prevent displacement of the pod relative to the pod housing.

18. The refillable dispenser of claim 1, wherein a surface area defined by the base container substantially corresponds to a surface area defined by the pod housing, thereby preventing the pod housing from rotating about the vertical axis upon rotation of the threaded shaft.

* * * * *